US006016408A

United States Patent [19]

Hashimoto et al.

[11] Patent Number: 6,016,408

[45] Date of Patent: Jan. 18, 2000

[54] DEVELOPER CARTRIDGE FOR DEVELOPING A LATENT IMAGE DETACHABLY MOUNTABLE TO A MAIN ASSEMBLY OF AN IMAGE FORMING APPARATUS

[75] Inventors: Kouji Hashimoto, Numazu; Yoshiro Tsuchiya, Yokohama; Kenji Matsuda, Numazu, all of Japan

[73] Assignee: Canon Kabushiki Kaisha, Tokyo, Japan

[21] Appl. No.: 08/943,691

[22] Filed: Oct. 3, 1997

[30] Foreign Application Priority Data

Oct. 7, 1996 [JP] Japan ..... 8-265783
Oct. 2, 1997 [JP] Japan ..... 9-269897

[51] Int. Cl.[7] ..... G03G 15/08

[52] U.S. Cl. ..... 399/27; 118/691; 118/694; 399/90; 399/119

[58] Field of Search ..... 399/27, 29, 61, 399/64, 90, 119, 227; 118/691, 694

[56] References Cited

U.S. PATENT DOCUMENTS

| | | | |
|---|---|---|---|
| 4,155,652 | 5/1979 | Buchan et al. | 399/64 |
| 4,369,733 | 1/1983 | Hirakura et al. | 118/691 |
| 4,620,783 | 11/1986 | Tanaka et al. | 399/27 |
| 4,707,108 | 11/1987 | Ohno | 399/227 |
| 4,883,019 | 11/1989 | Menjo et al. | 118/691 |
| 5,040,031 | 8/1991 | Hayashi | 395/114 |
| 5,561,496 | 10/1996 | Sugiura et al. | 399/107 |
| 5,617,188 | 4/1997 | Inomata | 399/13 |
| 5,642,187 | 6/1997 | Nomura et al. | 399/111 |
| 5,649,264 | 7/1997 | Domon et al. | 399/30 |
| 5,650,841 | 7/1997 | Matsuda et al. | 399/11 |
| 5,678,139 | 10/1997 | Nomura et al. | 399/114 |
| 5,697,022 | 12/1997 | Matsuda et al. | 399/102 |

OTHER PUBLICATIONS

European Search Report.

*Primary Examiner*—William J. Royer
*Attorney, Agent, or Firm*—Fitzpatrick, Cella, Harper & Scinto

[57] ABSTRACT

A developing cartridge for developing a latent image formed on a photosensitive member, which is detachably mountable to a main assembly of an electrophotographic image forming apparatus, includes a developing member for developing a latent image formed on the electrophotographic photosensitive member with toner; a toner accommodating portion for accommodating the toner to be used by the developing member; first and second light transmitting portions provided in the toner accommodating portion; a first light guide for directing, to the first light transmitting portion, light emitted by a light emission member provided in the main assembly; and a second light guide for directing the light having passed through the second light transmitting portion to a light receiving element provided in the main assembly.

12 Claims, 10 Drawing Sheets

DEVELOPER CARTRIDGE FOR DEVELOPING A LATENT IMAGE DETACHABLY MOUNTABLE TO A MAIN ASSEMBLY OF AN IMAGE FORMING APPARATUS

FIELD OF THE INVENTION AND RELATED ART

The present invention relates to a developing cartridge usable with an electrophotographic image forming apparatus such as an electrophotographic copying machine, printer or the like, and an electrophotographic image forming apparatus using the same.

The term electrophotographic image forming apparatus refers to an apparatus which forms an image on a recording material using an electrophotographic image forming process. It includes, for example, an electrophotographic copying machine, an electrophotographic printer (LED printer, laser beam printer), an electrophotographic printer type facsimile machine and an electrophotographic printer type word processor.

Recently, the demand for color electrophotographic image forming apparatus capable of forming color images, has increased.

In a known color developing cartridge, all of four color developing cartridges are carried on a turret (for example, U.S. Pat. No. 4,707,108, or U.S. Pat. No. 5,040,031). Such a structure is very effective in color image formation. The present invention is directed to a further development in this area.

In such a developing cartridge, it is known to detect the remaining amount of toner using an optical element.

SUMMARY OF THE INVENTION

Accordingly, it is a principal object of the present invention to provide a developing cartridge and an electrophotographic image forming apparatus in which the detection accuracy for detecting the remaining amount of toner is improved.

It is another object of the present invention to provide a developing cartridge and an electrophotographic image forming apparatus in which the latitude of a disposing position, in the main assembly, of a main assembly detecting member for detecting the remaining amount of toner is increased.

It is a further object of the present invention to provide a developing cartridge and an electrophotographic image forming apparatus including a first light guide for directing the light emitted from a light emission member provided in a main assembly of an apparatus to a first light transmitting portion and a second light guide for directing the light passed through the second light transmitting portion to a light receiving element provided in the main assembly of the apparatus.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described. First, a description will be provided as to a structure of a color electrophotographic image forming apparatus, and then as to a structure of a color developing cartridge used therewith.

(General Arrangement of Color Electrophotographic Image Forming Apparatus)

Figure 1:
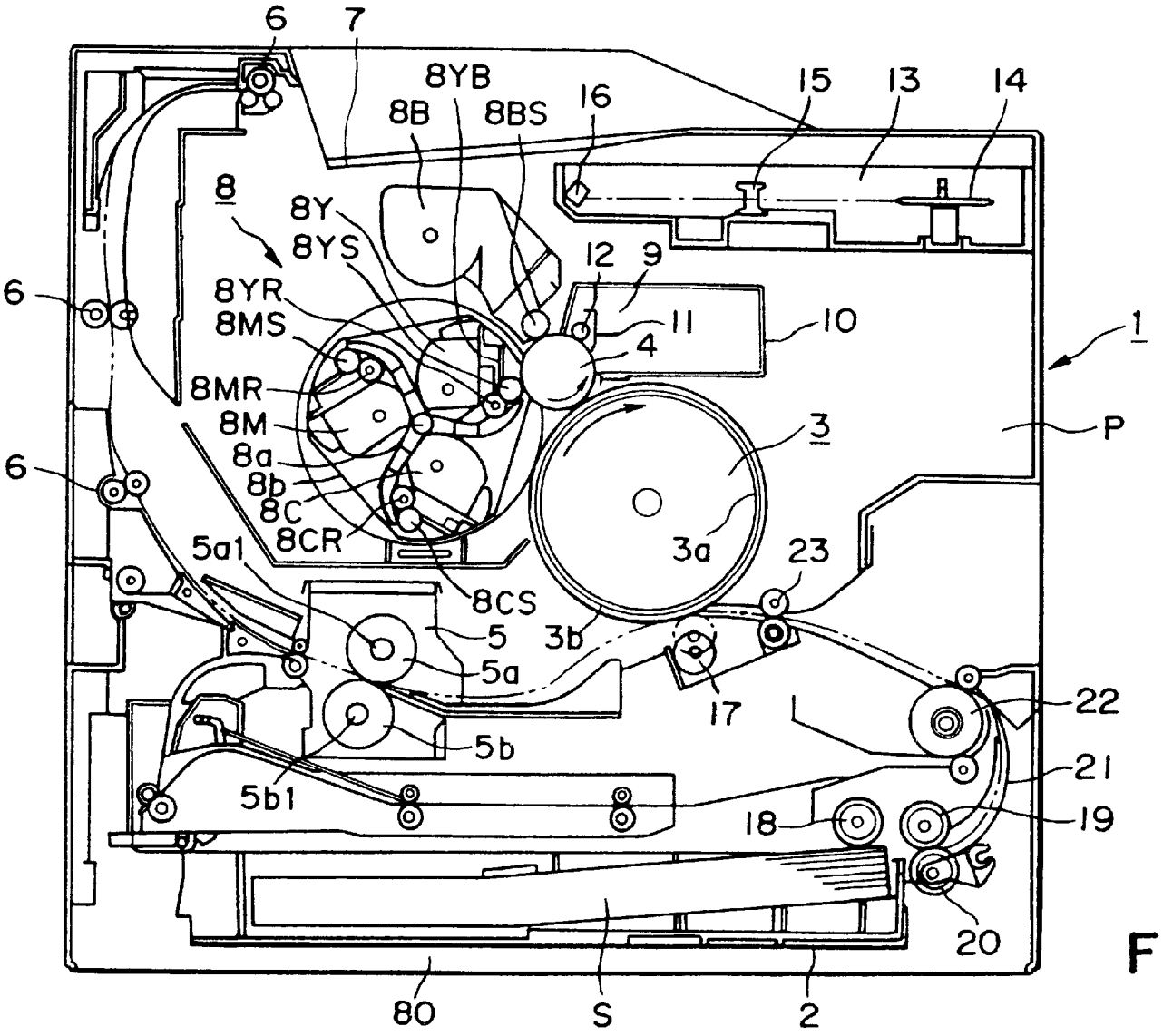
FIG. 1 is a schematic sectional view of an electrophotographic image forming apparatus using a developing cartridge according to an embodiment of the present invention.

FIG. 1 shows a general arrangement of a color laser printer as a color electrophotographic image forming apparatus according to an embodiment of the present invention.

The color laser printer P of this embodiment comprises an electrophotographic photosensitive member in the form of a drum (photosensitive drum) 4 which rotates at a constant speed, a developing device 8B (for development with black color toner), three color development devices (yellow developing device 8Y for development with yellow color toner, magenta developing device 8M for development with magenta color toner, and a cyan developing device 8C for development with cyan color toner) detachably mountable to a rotatable or revolvable turret.

Below the photosensitive drum 4, there is provided an intermediary transfer member 3 for carrying a superposedly transferred color image and for transferring the image onto a recording material S fed from a feeding portion.

The recording material S onto which the color image has been transferred, is fed to a fixing device 5 to fix the color image on the recording material S, and then the recording material S is discharged to a discharging portion 7 at the top of the apparatus by discharging rollers 6.

The rotatable or revolvable color development devices and the fixed black developing device are detachably mountable relative to the main assembly of the printer, independently from each other.

A description will be provided as to various parts of the image forming apparatus P.

(Drum Unit)

A drum unit 9 integrally contains the photosensitive drum 4 and a container 10 of a cleaning device functioning as a holder for the drum 4. The drum unit 9 is detachably mountable relative to the main assembly of the printer, and can be easily exchangeable when the lifetime of the photosensitive drum 4 is reached.

The photosensitive drum 4 of this embodiment comprises an aluminum cylinder having a diameter of 62 mm approximately and an organic photoconductive layer applied to the outside of the aluminum cylinder, and is rotatably supported on the container 10 of the cleaning device, which functions also as a housing for the photosensitive drum 4.

A cleaner blade 11 and a primary charging means 17 contact the outer peripheral surface of the photosensitive drum 4. The photosensitive drum 4 receives a driving force transmitted from a driving motor (unshown) at one longitudinal end, and is rotated in the counterclockwise direction in accordance with an image forming operation.

(Charging Means)

A charging means 12 is a contact charging type charger. A n electroconductive roller contacts the photosensitive drum 4, and the surface of the photosensitive drum 4 is uniformly charged by application of a voltage to the electroconductive roller.

(Exposing Means)

The exposure of the photosensitive drum 4 is effected by a scanner 13. More particularly, an image signal is supplied to a laser diode, and the laser diode projects a beam onto a polygonal mirror 14 at a timing corresponding the image signal. The polygonal mirror 14 rotates at a high speed by a scanner motor; the beam reflected by the polygonal mirror 14 is selectively projected onto the surface of the photosensitive drum 4 through an imaging lens 15 and a reflection mirror 16, so that charge latent image is formed on the photosensitive drum 4.

(Developing Means)

The developing means includes three rotary developing devices 8Y, 8M, 8C for development in yellow, magenta and cyan colors, and one black developing device 8B for development in black color to visualize the electrostatic latent image.

The black developing device 8B is a fixed developing device at a developing position for effecting the developing operation, except upon the mounting and demounting thereof relative to the main assembly of the apparatus. A developing roller 8BS is disposed opposed to the photosensitive drum 4 with a small clearance (approximately 300 $\mu$m) therebetween. It develops an image to visualize a black image with black toner on the photosensitive drum 4.

The black developing device 8B, as shown in FIG. 1, feeds the toner from the toner accommodating container toward the developing roller 8BS by a feeding mechanism. A toner application blade press-contacted to the outer periphery of the developing roller 8BS applies the toner in the form of a thin layer on the outer periphery of the developing roller 8BS which is rotating in the clockwise direction, and applies the charge to the toner (triboelectric charge). The developing roller 8BS is supplied with a developing bias, so that reverse development (jumping development) corresponding to the electrostatic latent image on the photosensitive drum 4 is effected to form a toner image on the surface of the drum.

In this embodiment, the toner capacity of the black developing device 8B is enough to print 15000 pages (A4, 5% print) which is larger than twice that of the toner capacity of the Y, M, C developing devices, in consideration of the toner consumption corresponding to the nature of the documents or image patterns printed by users.

By this, the frequency of exchange of the black developing device by the users can be reduced.

The position of the black developing device 8B is, as shown in FIG. 1, between the projection position where the photosensitive drum 4 is exposed to the beam from the laser scanner and a development position where the photosensitive drum 4 is subjected to a developing operation by the Y, M, C developing devices. Thus, the laser scanner is disposed above the developing devices. By this positional relation, the toner which might leak when the Y, M, C developing devices revolve, is prevented from scattering to the optical parts such as a laser scanner. Therefore, the polygonal mirror, the lens, the mirror, and the like are protected from toner deposition, so that sharp output images can be provided.

On the other hand, the three revolvable developing devices 8Y, 8M, 8C each contain toner for 6000 pages (A4, 5% printing). The three revolvable developing devices are detachably mounted on a developing turret 8*b*, which is revolvable about a shaft 8*a*.

Upon image formation, the turret 8*b* revolves about the shaft 8*a* while holding the Y, M, C developing devices to place a predetermined developing device to face the photosensitive drum 4. The developing roller 8YS of the developing device placed at the development position is disposed opposed to the photosensitive drum 4 with a small clearance approximately (300 $\mu$m), and develops the electrostatic latent image on the photosensitive drum 4 into a visualized image.

Upon color image formation, the developing turret 8*b* rotates for one rotation of the intermediary transfer member 3 so that developing processes are carried out in the order of the yellow developing device 8Y, the magenta developing device 8M, the cyan developing device 8C, and the black developing device 8B.

For example, when the yellow revolvable developing device 8Y is positioned at the developing position facing the photosensitive drum unit, the yellow revolvable developing device 8Y feeds toner from the container to the application roller 8YR by a feeding mechanism. By the functions of the application roller 8YR rotating in the clockwise direction and the blade 8YB press-contacted to the outer periphery of the developing roller 8YS, a thin layer of the toner is applied on the outer periphery of the developing roller 8YS rotating in the clockwise direction in FIG. 1, and the toner is triboelectrically charged. The developing roller 8YS is supplied with a developing bias so that a latent image formed on drum 4 upper is developed. The development is effected through the same process for the magenta developing device 8M and the cyan developing device 8C. The application of the bias to each developing roller and the transmission of the driving force thereto is carried out when the developing device is placed at the developing position.

(Intermediary Transfer Member)

The intermediary transfer member 3 superimposedly receives four visualized toner images (Y, M, C, B) from the photosensitive drum 4. It is rotated in the clockwise direction as shown in FIG. 1 in synchronism with the outer peripheral speed of the photosensitive drum 4.

The superimposed toner images on the intermediary transfer member 3 are transferred all together by a primary charging means or transfer roller 17 supplied with a voltage, onto a recording material S fed to and nipped between the intermediary transfer member 3 and the transfer roller 17.

The intermediary transfer member 3 in this embodiment comprises an aluminum cylinder 3*a* having a diameter of 186 mm and an elastic layer 3*b*, such as intermediate resistance sponge, intermediate resistance rubber or the like, on the outer periphery of the aluminum cylinder 3*a*. The intermediary transfer member 3 is rotatably supported and is driven by a gear (unshown) fixed thereto.

(Cleaning Means)

The cleaning means functions to remove the toner on the photosensitive drum 4 after the toner image provided by the developing means on the photosensitive drum 4 is transferred onto the intermediary transfer member 3. Thereafter, the removed toner is accumulation in the cleaner container 10. Normally, the amount of the removed toner accumulated in the container 10 does not fill the container 10 before the lifetime of the photosensitive drum is reached. Accordingly, normally the cleaner container 10 is exchanged integrally and simultaneously with the lifetime-end exchange of the photosensitive drum 4.

(Feeding Portion)

The feeding portion functions to feed the recording material S into the image formation station. It comprises a cassette 2 for accommodating a plurality of recording materials S, a pick-up roller 18, a feeding roller 19, a retarding roller 20 for preventing double feeding, a feeding guide 21 and a registration roller 22.

Upon image formation, the pick up roller 18 is rotated in accordance with the image forming operation to feed the recording materials S from the cassette 2, one-by-one. The recording material S separated and fed out, is guided by the guide 21, and introduced to the registration roller 23 by the registration roller 22. During the image forming operation, the registration roller 23 rotates and stops in a predetermined sequence to feed the recording material S in synchronism with the transfer process.

(Transfer Portion)

The transfer portion is provided with a swingable transfer roller 17. The transfer roller 17 comprises a metal shaft wrapped with an intermediate resistance foamed elastic member and a driving shaft, and is movable in the vertical direction in FIG. 1.

While the four color toner images are formed on the intermediary transfer member 3, that is, while the intermediary transfer member 3 is rotated a plurality of turns, the transfer roller 17 is at a lower position as shown in FIG. 1, and is separated from the intermediary transfer member 3 so that the toner image is not disturbed.

After the four color toner images are formed on the intermediary transfer member 3, the transfer roller 17 is urged toward an upper position indicated by chain lines in FIG. 1 at a predetermined pressure toward the intermediary transfer member 3 at a predetermined timing for transferring the color image onto the recording material S. Simultaneously therewith, the transfer roller 17 is supplied with a bias voltage so as to transfer the toner image onto the recording material S from the intermediary transfer member 3.

The recording material S nipped between the intermediary transfer member 3 and the transfer roller 17, is advanced at a predetermined speed to the left in FIG. 1 during the transfer process, and is fed to a fixing device.

(Fixing Portion)

The fixing device 5 functions to fix the toner image on the recording material. As shown in FIG. 1, the fixing device 5 comprises a fixing roller 5*a* for applying heat to the recording material S, and a pressing roller 5*b* for press-contacting the recording material S to the fixing roller 5*a*. These rollers are hollow and contain heaters 5*a*1, 5*b*1. By the rotation of the rollers, the recording material S is fed. The recording material S carrying the toner image is fed by the fixing roller 5*a* and the pressing roller 5*b*, and simultaneously therewith, heat and pressure are applied, by which the toner image is fixed on the recording material S.

Figure 2:
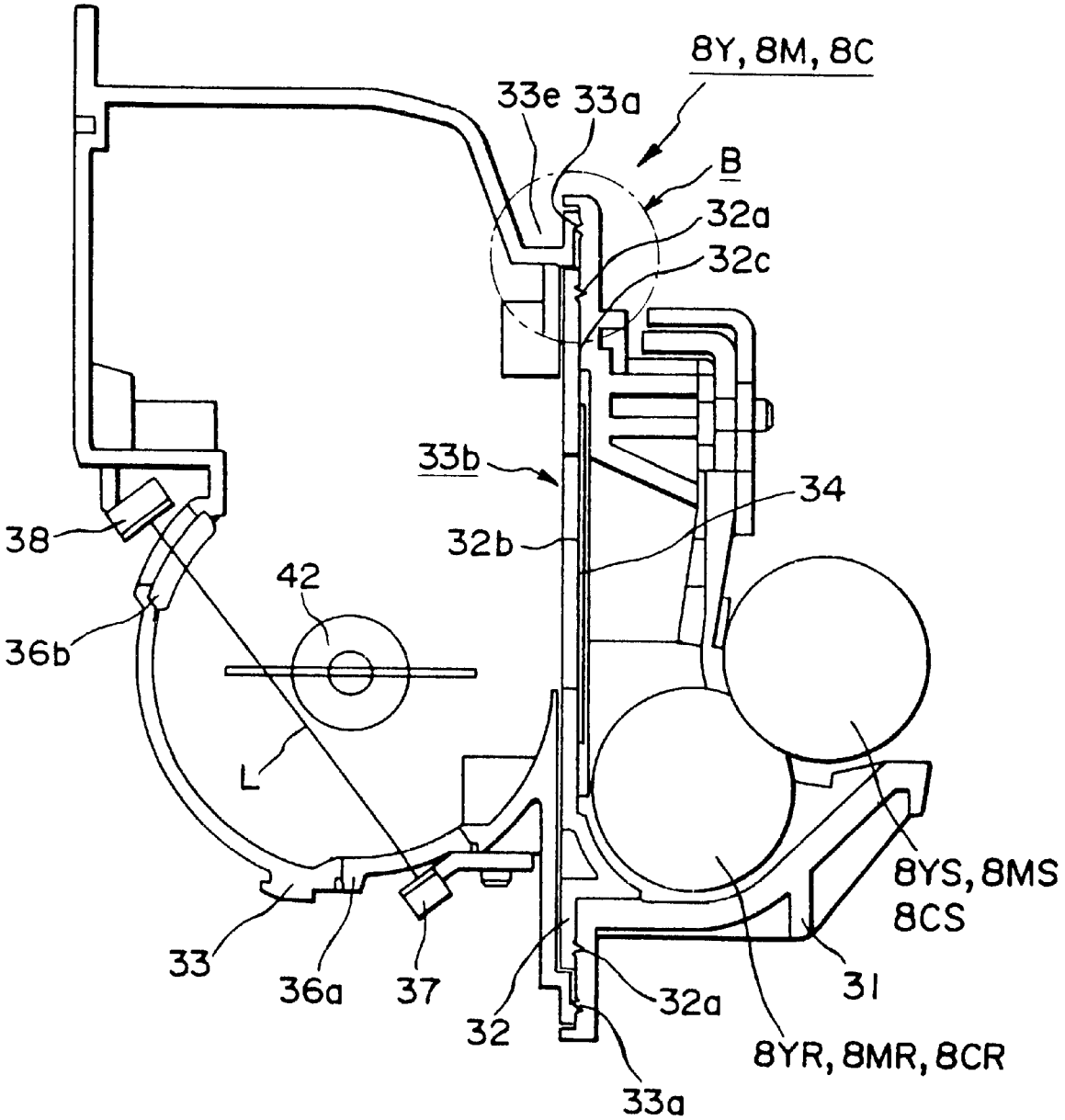
FIG. 2 is a schematic sectional view of a developing cartridge according to an embodiment of the present invention.
Figure 3:
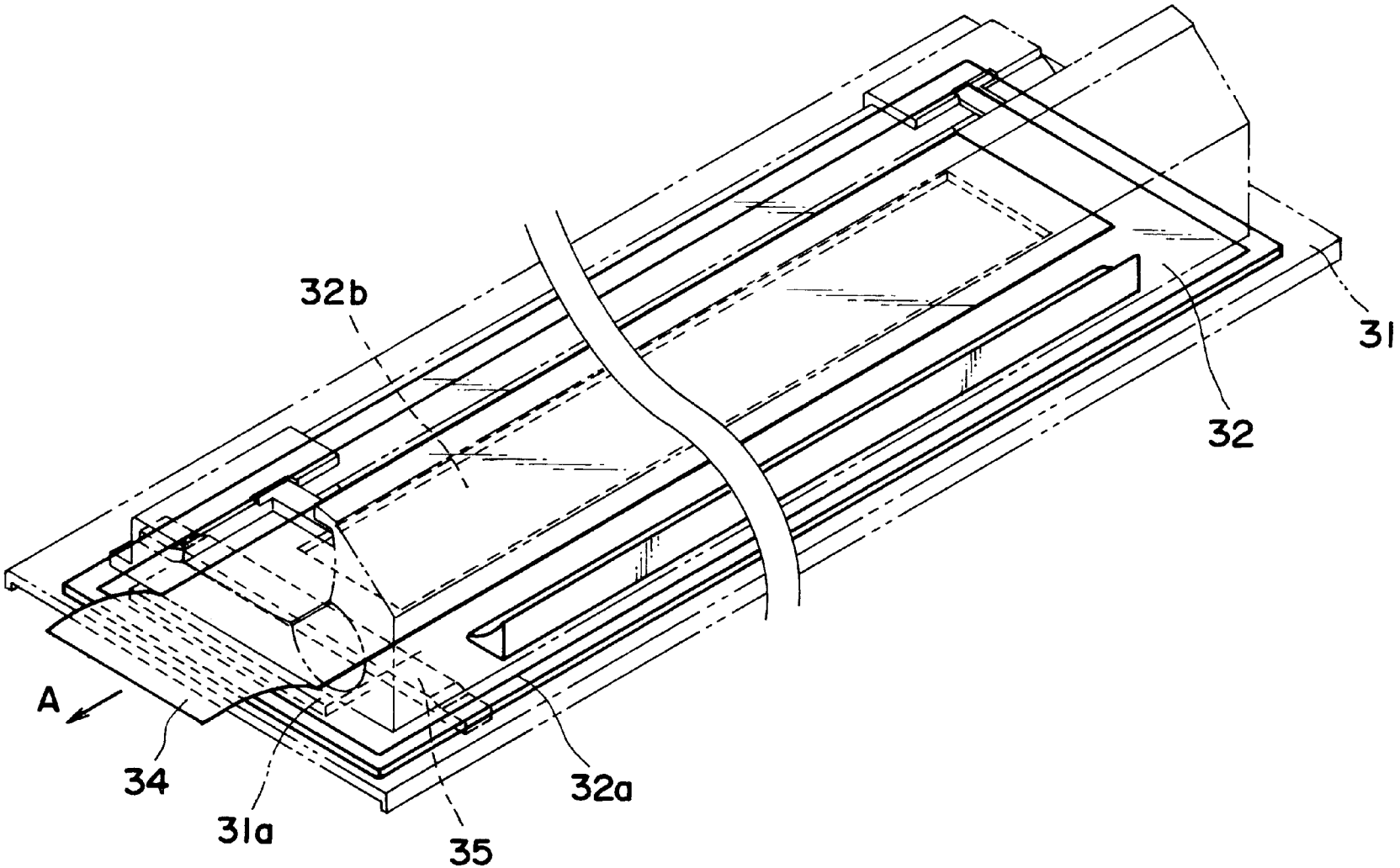
FIG. 3 is a perspective view of a seal member and elements therearound of a developing cartridge according to an embodiment of the present invention.
Figure 4:
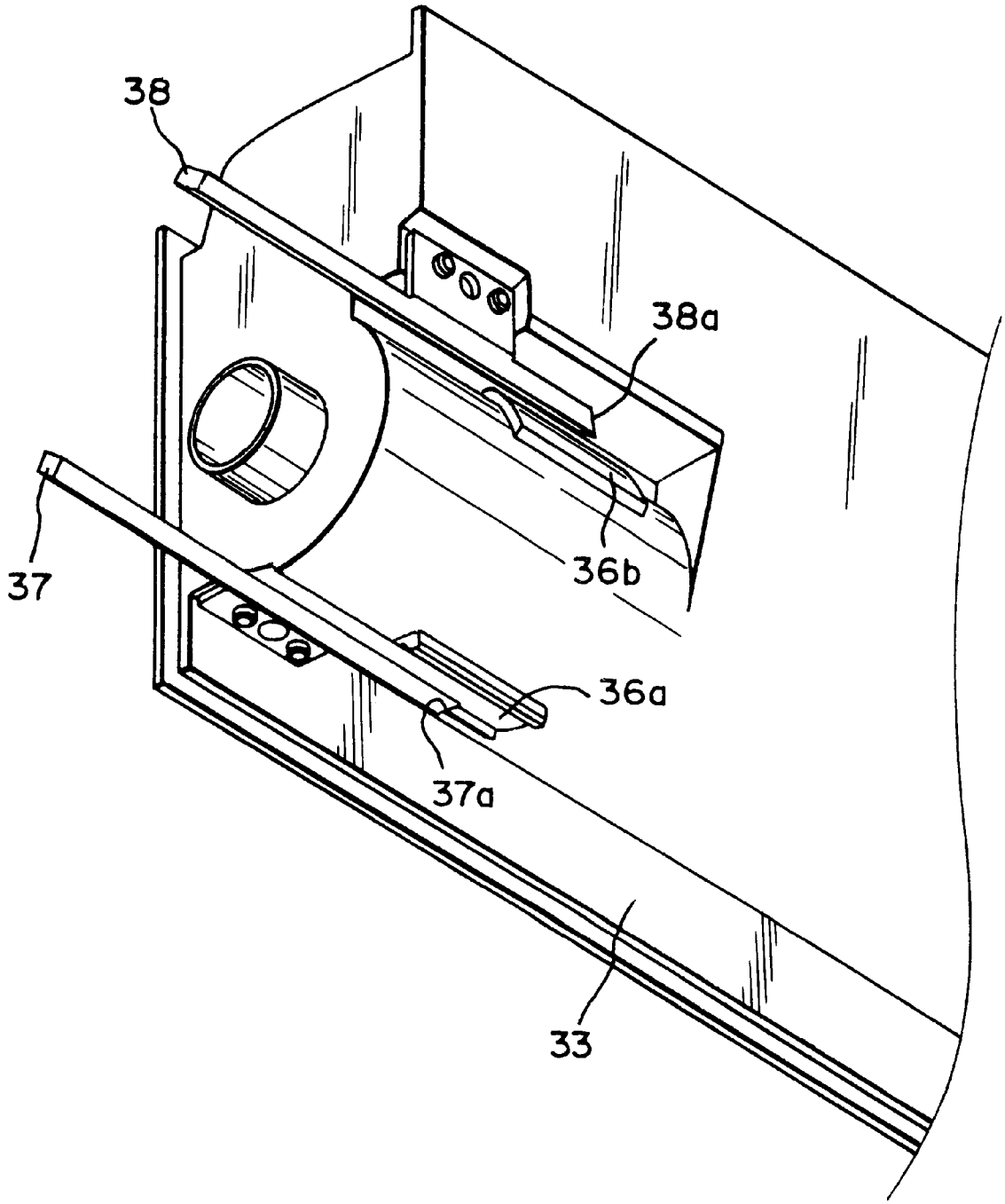
FIG. 4 is a perspective view of a light transmission member and elements therearound provided in a developing cartridge according to an embodiment of the present invention.
Figure 5:
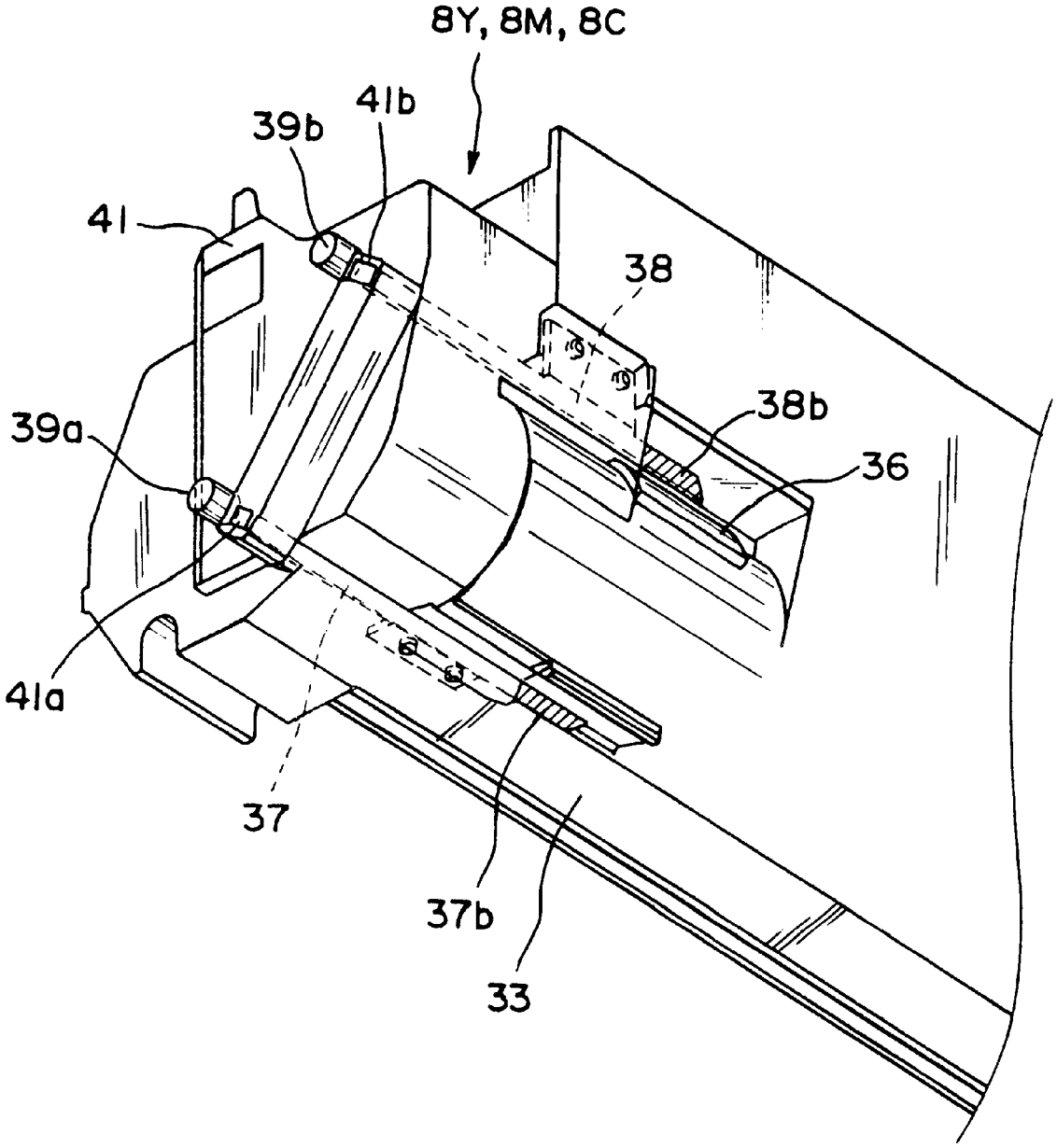
FIG. 5 is a perspective view of a light transmission member and elements therearound of a light transmission port provided in a developing cartridge according to an embodiment of the present invention.
Figure 6:
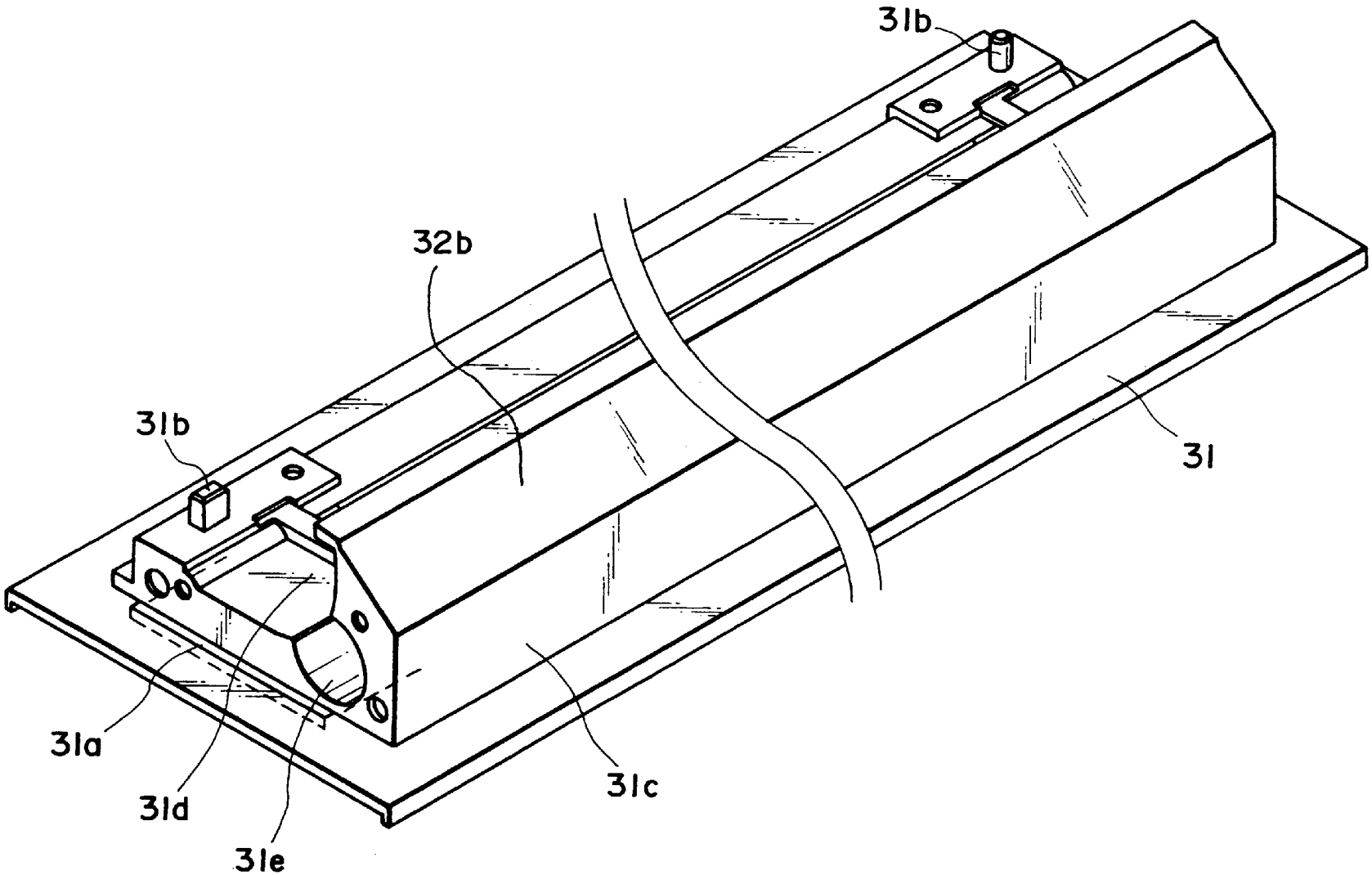
FIG. 6 is a perspective view of a toner frame according to an embodiment of the present invention.
Figure 7:
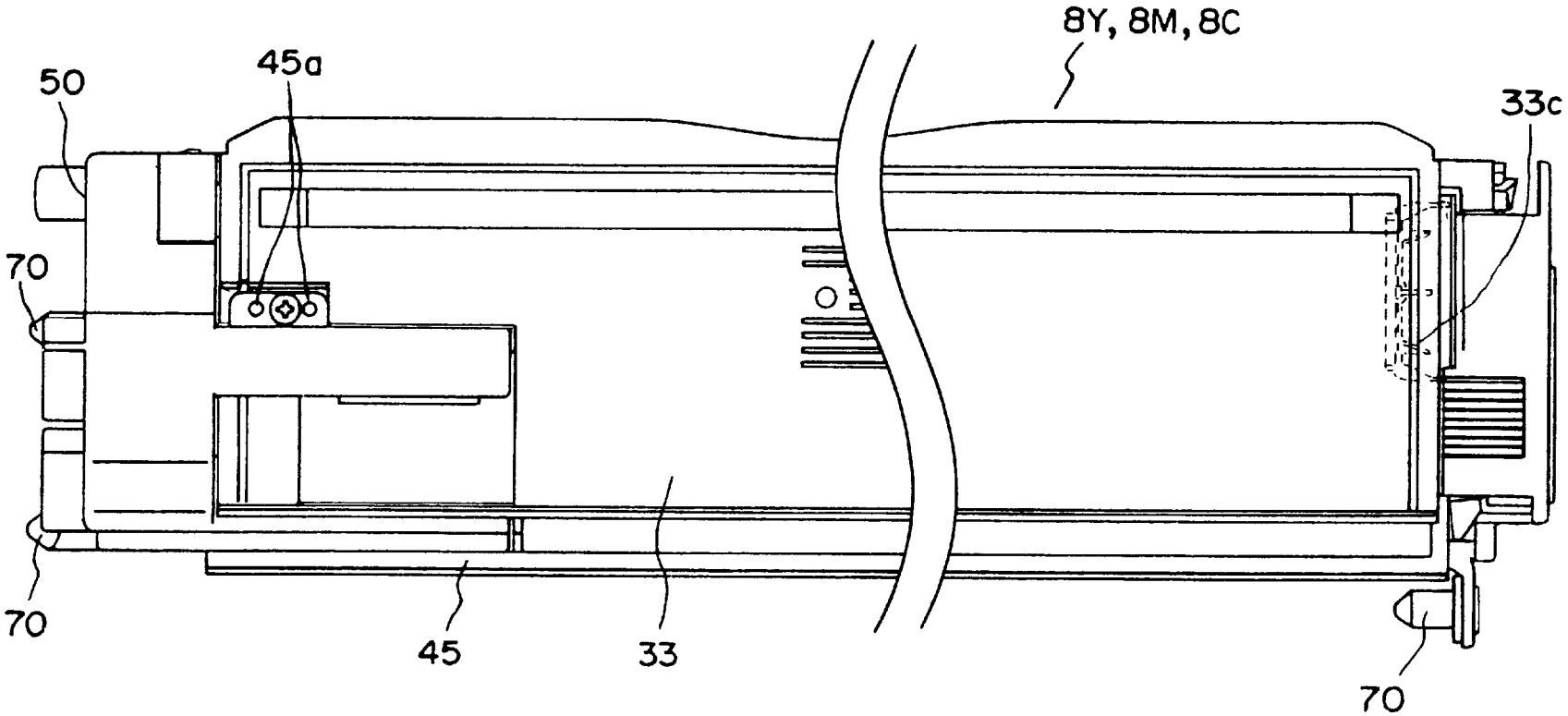
FIG. 7 is a top plan view of a developing cartridge according to an embodiment of the present invention.
Figure 8:
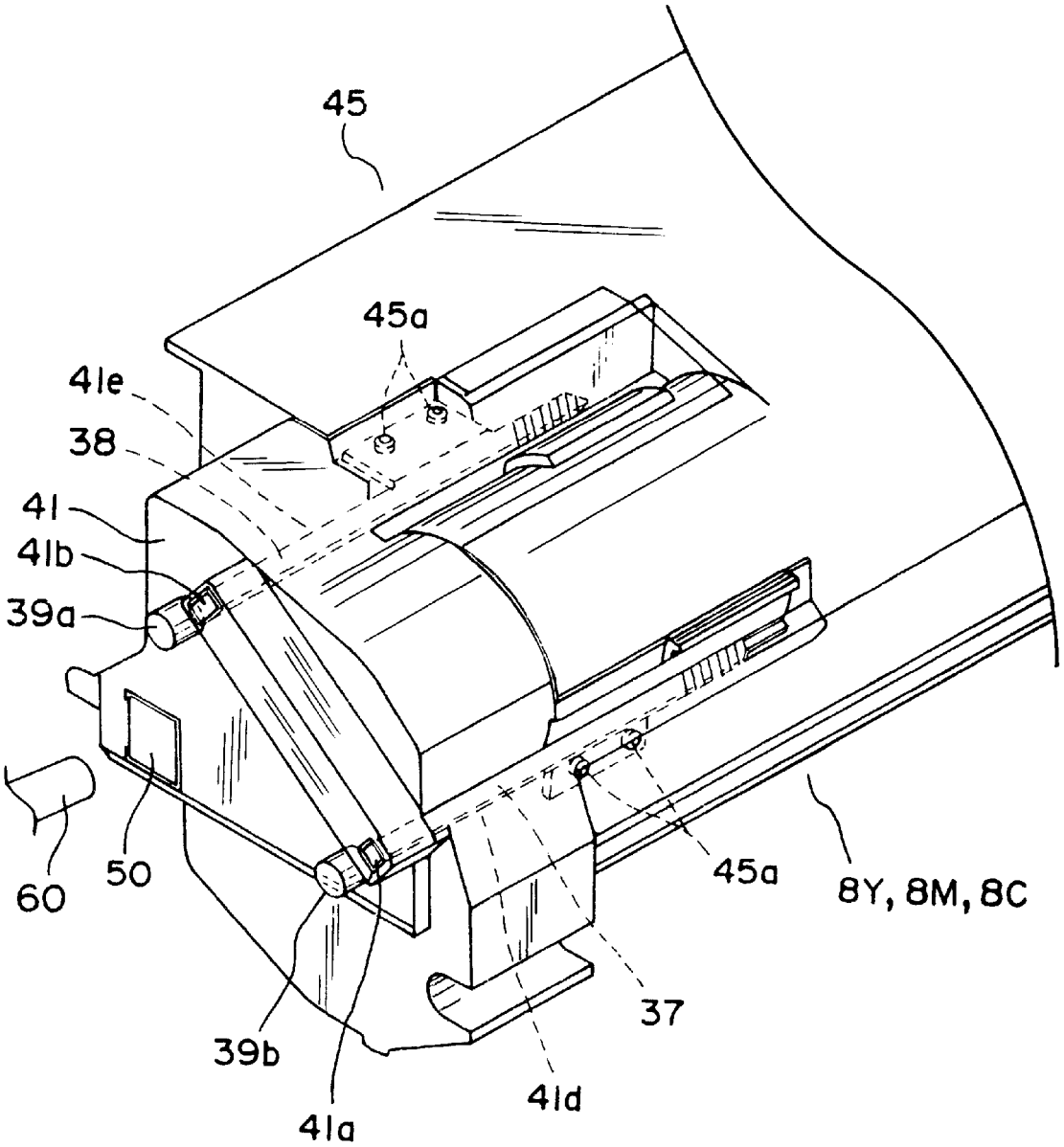
FIG. 8 is a perspective view of an end portion of a developing cartridge according to another embodiment of the present invention.
Figure 9:
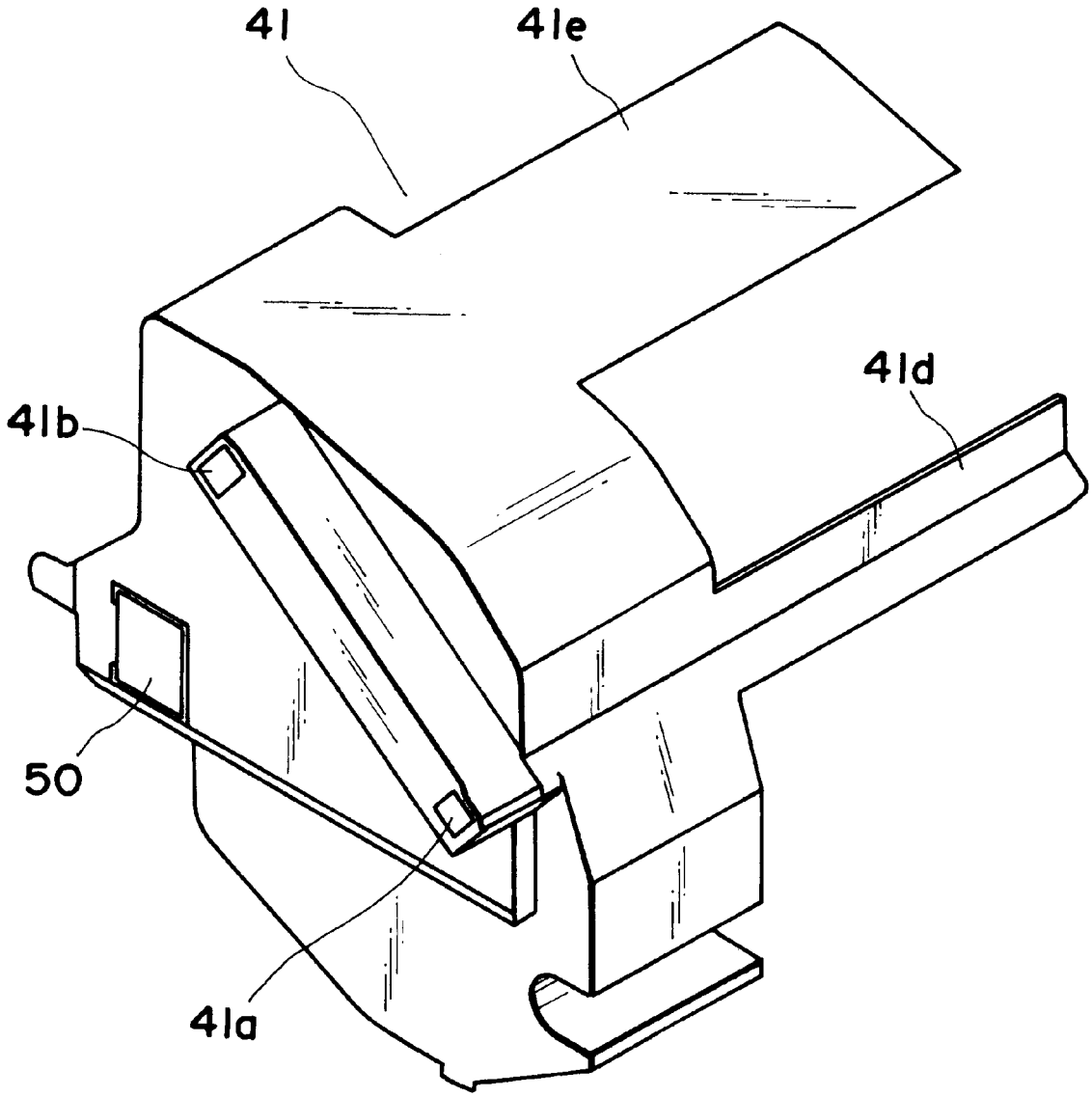
FIG. 9 is a perspective view of a cover for a developing cartridge of FIG. 8.
Figure 10:
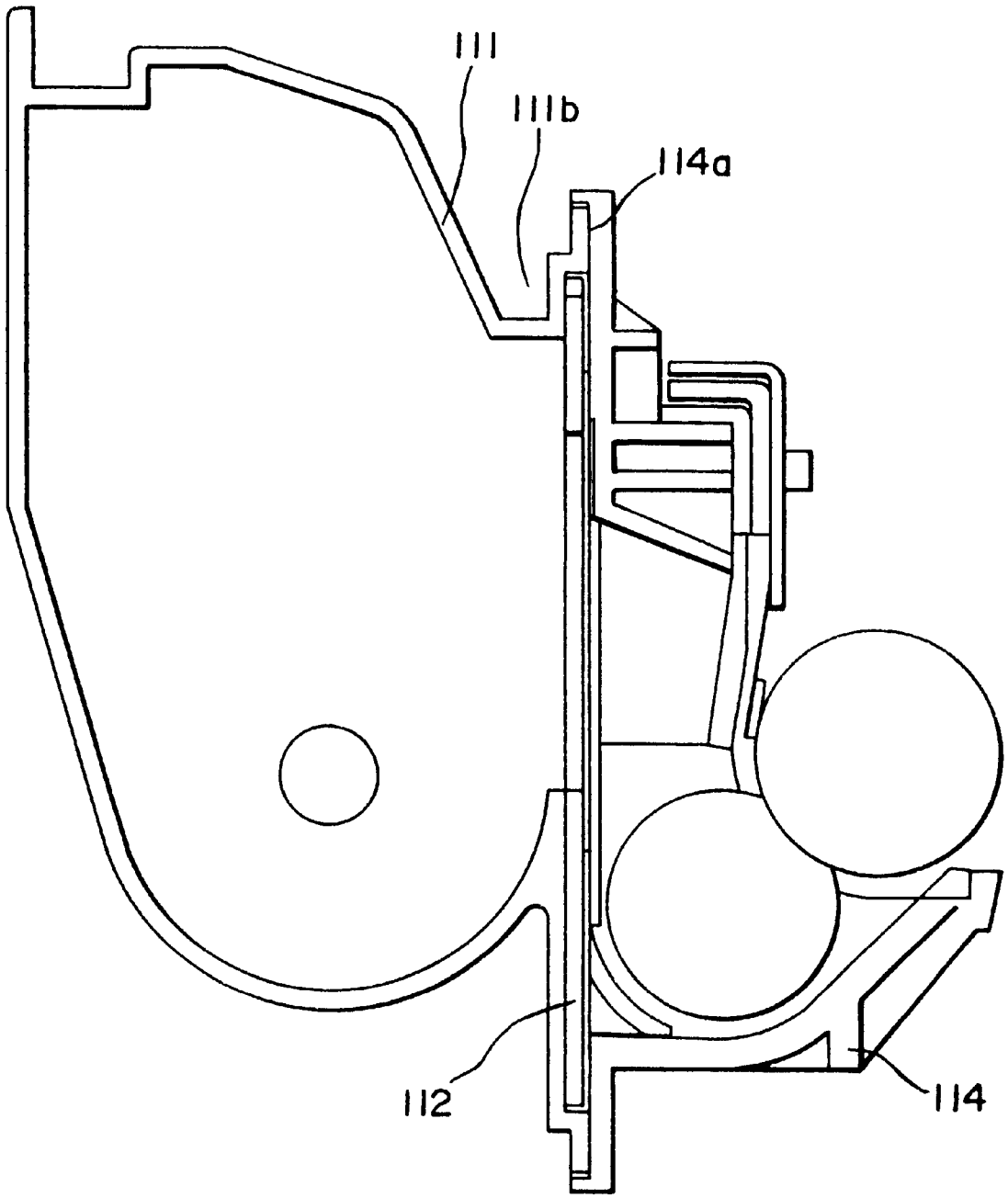
FIG. 10 is a side view for illustrating advantages of this embodiment.

Referring to FIGS. 2–9, the color developing cartridges (8Y, 8M, 8C) will be disclosed in detail. FIG. 2 is a sectional view of a color developing cartridge according to an embodiment of the present invention. FIG. 3 is a perspective view of a seal member and parts therearound of a developing cartridge according to an embodiment of the present invention. FIGS. 4 and 5 are perspective views of a light transmission port and a light guide and parts therearound of a color developing cartridge according to another embodiment of the present invention. FIG. 6 is a perspective view of a toner frame. FIG. 7 is a top plan view of a color developing cartridge. FIG. 8 is a perspective view of a color developing cartridge according to another embodiment of the present invention. FIG. 9 is a perspective view of a cover. FIG. 10 is a side view for illustrating the effects of this embodiment.

In a color developing cartridge (8Y, 8M, 8C) shown in FIG. 2, a cap member 32 on which a flexible toner seal 34 is welded, is welded on a developing frame 31 by a welding rib portion 32*a*. The frame 31 of the color developing cartridge (8Y, 8M, 8C) is provided with openings 36*a*, 36*b* formed by an insertion molding, and a toner frame 45 having a toner container 33 with light transmission ports provided with light transmission members welded by a welding rib portion 33*a* to the openings 36*a*, 36*b*, thus forming a unit. Thereafter, toner (developer (toner)) is supplied into the toner container 33 through the toner filling opening 33*c* (FIG. 7). After the toner filling, the part such as the supplying rollers 8YR, 8MR, 8CR and the developing rollers 8YS, 8MS, 8CS are mounted to the developing frame 31. Thus, each of the developing cartridges (8Y, 8M, 8C) is manufactured. Designated by 31*d* is a developing roller mounting portion provided in the developing frame 31, and the developing roller (8YS, 8MS, 8CS) is positioned there. Designated by 31*e* is a supplying roller mounting portion, and the supplying roller (8YR, 8MR, 8CR) is positioned there.

As shown in FIGS. 2 and 3, a cap member 32 having an opening 32*b* of a predetermined size is welded to the developing frame 31 all around the four sides thereof using the welded rib portion 32*a* through ultrasonic welding, vibration welding, or the like. A toner frame 45 having a toner container 33 which has an opening 33*b* of a predetermined size and which functions to accommodate the toner, is welded to the developing frame 31 all around the four sides thereof by the welded rib portion 33*a* through ultrasonic welding, vibration welding, or the like.

The cap member 32 is disposed so as to confine a part of the opening 33*b* of the toner container 33. As shown in FIG. 3, a toner seal 34, for hermetically closing the opening 32*b* of the cap member 32, is separably mounted through welding or the like to the cap member 32. The toner seal 34 is mounted to such a side of the cap member 32 as has the supplying roller 8YR, 8MR, 8CR.

When the user uses the color developing cartridge (8Y, 8M, 8C), the toner seal 34 is pulled out through the toner seal opening 31*a* of the developing frame 31 in the direction of arrow A away from the sheet of the drawing of FIG. 3, prior to mounting the color developing cartridge (8Y, 8M, 8C) to the main assembly 80 of the apparatus. By doing so, the toner accommodated in the toner container 33 is discharged through the opening 32*b* of the toner cap member 32, and is supplied to the supplying roller 8YR, 8MR, 8CR or the like in the developing frame 31.

As shown in FIG. 3, the toner seal opening 31*a* is formed downstream of the opening 32*b* of the cap member 32 with respect to the toner seal pulling direction (indicated by the arrow A). The toner seal opening 31*a* has an elongated configuration extending along a short side of the developing frame 31 having a substantially rectangular configuration.

The toner seal 34 is pulled out and removed through the toner seal opening 31*a* in a direction different from the direction along the side surface 32*c* on which the toner seal 34 is welded, namely in the direction away from the sheet of the drawing of FIG. 3. Therefore, all of the four sides of the cap member 32 can be welded to the developing frame 31, by which the welding strength between the cap member 32 and the developing frame 31 can be assured. Thus, the toner can be prevented assuredly from leaking between the cap member 32 and the developing frame 31.

The toner seal may be an easy peel type, by which the opening 32*b* is unsealed by peeling, or may be a tear-tape type or the like, by which the opening 32*b* is unsealed by tearing.

As shown in FIG. 3, an elastic seal member 35 extends between the cap member 32 and the developing frame 31 in the longitudinal direction of the toner seal opening 31*a* of the developing frame 31. Therefore, the toner discharged through the opening 32*b* of the cap member 32 does not leaked through the toner seal opening 31*a* of the developing frame 31.

With this structure, the toner frame 45, having the cap member 32 and the toner container 33, is welded to the developing frame 31 all around the four sides thereof, and has a proper strength balance. Therefore, the toner container 33 and the developing frame 31 are not warped. Additionally, the welded portion is not peeled even upon vibration, falling, or the like.

The cap member 32 and the toner frame 45 are welded to the developing frame 31 at the four sides thereof. For this reason, the seal member 34 is strongly compressed between the cap member 32 and the seal member 35. Thus, the toner is prevented from leaking through the toner seal opening 31*a* formed in the developing frame 31.

As shown in FIG. 2, in this embodiment, after the cap member 32 is welded to the developing frame 31 by using the welded rib portion 32*a,* the toner frame 45 is welded to the developing frame 31 by using the welded rib portion 32*a.* In the B parts in FIG. 2, when the cap member 32 is welded to the developing frame 31, the welding operation can be carried out without the toner frame 45 mounted. Therefore, during the welding operation, a receptor portion (unshown) of a tool for the welding operation can support the cap member 32 without any problem. When the toner frame 45 is welded to the developing frame 31 after the cap member 32 is welded to the developing frame 31, what is required to provide, in the toner container 33, a relatively shallow space 33*e* enough to permit the receptor portion (unshown) of the tool for the welding operation to enter toward the toner frame 45 (toner container 33). The space 33*e* may be small, and therefore, the size of the toner container 33 can be increased, thus increasing the toner accommodation capacity. When the toner frame 45 and the developing frame 31 are welded to each other, the portion of the space 33*e* is supported by a receptor portion (unshown) of the tool.

Referring to FIG. 10, the effects of this embodiment will be described. What is disclosed in FIG. 10 is not known, but has been considered by the inventors during the development of the present invention.

With the structure shown FIG. 10, the toner frame 111 and the cap member 112 are welded by using the welded rib portion 114*a* for welding the toner frame 111 and the cap member 112 to each other and the welded rib portion 114*a* for welding the toner frame 111 and the developing frame 114 to each other, and then the toner frame 111 and the developing frame 114 are welded to each other. In other words, the cap member 112 is welded to the toner frame 111. Therefore, it is required that the space 111*b* for inserting the receptor portion (unshown) of the tool for the welding operation has a relatively large depth. Therefore, the toner filling capacity of the toner frame 111 is correspondingly smaller.

According to this embodiment, however, the developing frame 114 and the toner frame 111 are welded to each other after the developing frame 114 and the cap member 112 are welded to each other. As will be apparent if the space 33*e* shown in FIG. 2 and the space 111*b* shown in FIG. 10 are compared with each other, more toner can be accommodated by the FIG. 2 structure.

The foregoing embodiment can be summarized as follows:

A developing cartridge (8Y, 8M, 8C) for developing a latent image formed on the photosensitive member (4), wherein the said developing cartridge is detachably mountable to a main assembly (1) of an electrophotographic image forming apparatus, the developing cartridge comprising;

A developing member (e.g. one of developing rollers 8YS, 8MS, 8CS) for developing a latent image formed on the electrophotographic photosensitive member (4) with toner;

A toner accommodating portion (e.g. toner container 33) for accommodating the toner to be used for development by the developing member;

A toner supply opening (33*b*), provided in the toner accommodating portion (33), for supplying the toner accommodated in the toner accommodating portion (33) to the developing member;

A toner seal (34) for blocking the toner from being supplied from the toner supply opening (33*b*) toward the developing member;

A developing frame (31) including a developing member mounting portion (31*d*) for mounting the developing member, the developing frame (31) being provided with a toner passing opening (31*e*) for passing the toner supplied from the toner supply opening (33*b*);

A toner frame (45) supporting the toner accommodating portion (33), the toner frame (45) and the developing frame (31) are bonded together all around their peripheries;

A toner seal opening (31*a*) for passing the toner seal (34) provided between a toner passing opening (31*e*) of the developing frame (45) and a bonding portion between the toner frame and the developing frame, wherein the toner seal (34) is pulled out along the toner seal opening (31*a*) prior to start of use of the developing cartridge (8Y, 8M, 8C), thereby permitting the toner to be supplied from the toner supply opening (33*b*) toward the developing member.

A toner regulating plate (e.g. cap member 32) having an opening region (32*b*) of a predetermined size for limiting an amount of the toner supplied from the toner supply opening (33*b*), is provided in the developing frame 31 opposed to the toner supply opening (33*b*). Here, the toner seal (34) is mounted on the toner regulating plate (32).

The toner seal opening (31*a*) is disposed at an end opposite from an end adjacent to which the developing bias contact (50) is provided in a longitudinal direction of the developing frame (31), wherein the developing bias contact (50) receives a developing bias to be supplied from the main assembly (1) to the developing member (8YS, 8MS, 8CS) when the developing cartridge (8Y, 8M, 8C) is mounted to the main assembly (1) of the apparatus, and the developing bias contact (50) is exposed at a longitudinal end of the developing cartridge (8Y, 8M, 8C). When the developing cartridge (8Y, 8M, 8C) is mounted to the main assembly 1 of the apparatus, the developing bias contact (50) is electrically connected with a main assembly developing bias contact (60) to receive the developing bias from the main assembly 1. The toner seal opening (31*a*) is disposed at the same end portion where a toner filling opening (33*c*) is provided in said toner accommodating portion (33) to fill the toner into the toner accommodating portion (33), in a longitudinal direction of the developing frame (31).

A cover member (41) is detachably mounded at an end of the developing cartridge (8Y, 8M, BC), wherein said cover is provided with the developing bias contact (50).

The developing frame (31) and the toner passing opening (31*e*) have substantially rectangular shapes, and the toner seal opening (31*a*) is disposed between a short side of the rectangular shape of the developing frame (31) and a short side of the rectangular shape of the toner passing opening, and the toner seal opening (31*a*) is an elongated opening extended along a short side of the rectangular shape of the developing frame (31).

The toner frame (33) and developing frame (31) are bonded with each other all around their peripheries by adhesive material, welding or ultrasonic welding.

In FIG. 2, light transmission ports 36*a,* 36*b* for toner remaining amount detection is formed through insertion molding upon integral molding of the toner container 33. An integral molding method for the toner container 33 includes a transition timing of shifting (mold opening process, mold sliding process) from a primary molding step (for simultaneous molding of the toner frame 45 (toner container 33) and cap member 32) to a secondary molding step (for joining a cap member (toner container 33) and the cap member 32 by resin material molding). So, the formation of the light transmission ports 36*a,* 36*b* in the toner container 33 by insertion molding during the shifting step, does not result in a cost increase. As for the material of the light transmission members polystyrene or the like resin is usable.

While the toner container 33 may be molded, the light transmission members, may be formed simultaneously, and it may be inserted into the toner container 33, by which the insertion can be carried out when the material defining the light transmission ports 36*a,* 36*b* are not yet completely cooled, and therefore, the strain or dimension change is small.

In FIG. 6, designated by 31*b* is a developing blade positioning pin, and 31*c* is a cover.

As shown in FIGS. 2, 4 and 5, the detected light L emitted from the emission lamp 39*a,* for detection of the toner remaining amount provided in the main assembly 1 of the image forming apparatus, travels through a first light guide (light transmission member) 37 and is reflected by an inclined surface 37*a* inclined by 45° relative to the direction of the entering detection light L, and travels through the light transmission ports 36*a,* 36*b;* and then, it is reflected by an inclined surface 38*a* inclined by 45° relative to the direction of the entering detection light L of the second light guide (light transmission member) 38, and travels through the second light guide (light transmission member) 38 and finally received by a photoreceptor sensor 39*b,* for detecting the toner remaining amount provided in the main assembly 1.

Here, the first and second light guides (light transmission member) 37 and 38 are directly mounted to the outer surface of the toner container 33. As described in the foregoing, the light transmission ports 36*a,* 36*b* are formed in the toner container 33 by insertion molding. Therefore, the positional accuracy of the first and second light guides (light transmission members) 37 and 38 relative to the light transmission port 36*a* and 36*b* can be assured by assuring the positional accuracy between the mounting seat for the first and second light guides (light transmission members) 37 and 38 and the light transmission ports 36*a* and 36*b*. In this embodiment, a supporting member is positioned by a positioning pin 45*a* integrally molded with the toner frame 45. Therefore, the positional accuracy of the first and second light guide 37 and 38 relative to the light transmission port 36*a* ands 36*b* is improved.

The first, second light guides (light transmission member) 37, 38 are extended in parallel with the longitudinal direction of the color developing cartridges 8Y, 8M, 8C, so that even when the color developing cartridges 8Y, 8M, 8C are mounted on a revolvable developing turret 8*b,* the entering direction of the detected light L is always parallel with the axis of revolution of the developing turret 8*b*. Therefore, if the positioning is assured between the emission lamp 39*a* and the photoreceptor sensor 39*b* and the first, second light guides (light transmission members) 37, 38, the detection light L can be assuredly passed through the light transmission ports 36*a,* 36*b*.

As shown in FIG. 2, in this embodiment, the first, second light guides (light transmission members) 37, 38 are disposed across the welding rib portion 33*a* which is a welded portion between the toner frame 45 and the developing frame 31, from the developing rollers 8YS, 8MS, 8CS and the supplying rollers 8YR, 8MR, 8CR. Therefore, toner scattered from the developing rollers 8YS, 8MS, 8CS, supplying rollers 8YR, 8MR, 8CR and the like, is stopped at the welding rib portion 33*a,* which is the welded portion. For this reason, the first and second light guides (light transmission members) 37 and 38 are not easily contaminated by the scattered toner.

As shown in FIG. 5, the first, second light guides 37, 38 are covered by a cover member 41 provided at the side surface portion of the color developing cartridges 8Y, 8M, 8C except for the exposed portions 37*b,* 38*b* opposed to the light transmission ports 36*a,* 36*b*. Therefore, even if toner scatters through the welded portion between the toner frame 45 and the developing frame 31, the first, second light guides (light transmission members) 37, 38 are not easily contaminated.

Because the portions 37*b,* 38*b* of the first, second light guides 37, 38 are exposed, the mounting thereof can be easily checked in the assembling plant of the color developing cartridge. Additionally, the user can easily check the toner remaining amount by observation through the light transmission ports 36*a,* 36*b* and the exposed portions 37*b,* 38*b* of the first, second light guides (light transmission member) 37, 38.

As shown in FIG. 8, by substantially completely covering first, second light guides 37, 38 by extensions 41*d,* 41*e* of the cover member 41, deposition of the toner can be assuredly prevented, so that deterioration of the light guides 37, 38 can be avoided.

One longitudinal end of the first and second light guides 37 and 38 is supported by supporting portions 41*a* and 41*b* of the cover member 41, respectively, so that positional deviation or the like of the first and second light guides 37 and 38 due to vibration, falling, or the like can be prevented.

A toner stirring member 42 (FIG. 2), disposed in the toner container 33, is assembled simultaneously with the integral molding of the toner container 33. By detecting a transmission factor of the detecting light L when the toner is stirred in the toner container 33 by the rotation of the toner stirring member 42, the remaining amount of the toner in the toner container 33 is detected by the main assembly 1 of the apparatus. When the main assembly 1 detects that remaining amount of the toner decreases to a predetermined amount, the main assembly 1 carries out exchange notification (flickering of a lamp or the like) (level 1). When it detects further reduction of the remaining amount of the toner, it stops the operation of the main assembly 1 (level 2). The first and second light guides 37 and 38 are made of polymethylmetaacrylate resin material.

The foregoing embodiment can be summarized as follows:

A developing cartridge (8Y, 8M, 8C) for developing a latent image formed on the photosensitive member (4), wherein the developing cartridge is detachably mountable to a main assembly (1) of an electrophotographic image forming apparatus, the developing cartridge comprising;

A developing member (e.g. one of developing rollers 8YS, 8MS, 8CS) for developing a latent image formed on the electrophotographic photosensitive member (4) with toner;

A toner accommodating portion (e.g. toner container 33) for accommodating the toner to be used for development by the developing member;

A first light transmitting portion or port (36*a*) and a second light transmitting portion (36*b*) provided in a toner accommodating portion;

A first light guide (37) for directing, to the first light transmitting portion (36*a*), light emitted by a light emission member (e.g. emission lamp 39*a*) provided in the main assembly (1);

A second light guide (38) for directing the light having passed through the second light transmitting portion (36*b*) to a light receiving element (e.g. photoreceptor sensor 39*b*) provided in the main assembly (1);

By this, the main assembly (1) of the apparatus can be notified of a decrease of the toner amount accommodated in the toner accommodating portion (33).

The first light transmitting portion (36*a*) and second light transmitting portion (36*b*) are disposed at positions closer to a longitudinal end where a developing bias contact (50) is provided than the opposite longitudinal end, wherein the developing bias contact (50) receives a developing bias to be supplied to the developing member from the main assembly (1) when the developing cartridge (8Y, 8M, fC) is mounted to the main assembly (1), and wherein the developing bias contact (50) is exposed at a longitudinal end of said developing cartridge (8Y, 8M, 8C).

An end of the first light guide (37) is opposed to the first light transmitting portion (36*a*), and the other end thereof is exposed at the end of developing cartridge (8Y, 8M, 8C) where the developing bias contact (50) is provided.

An end of the second light guide (38) is opposed to the second light transmitting portion (36*b*), and the other end thereof is exposed at the end of developing cartridge (8Y, 8M, 8C) where said developing bias contact (50) is provided.

The first light guide (37) is positioned below the second light guide (38) when the developing cartridge (8Y, 8M, 8C) is mounted to the main assembly (1).

A filling opening (33*c*) for filling the toner into the toner accommodating portion (33) is provided at an end opposite from an end where said developing bias contact (50) is provided, in the longitudinal direction of the toner accommodating portion (33).

A cover member (41) is detachably mounted to an end of the developing cartridge (8Y, 8M, 8C), wherein the first light guide (37) and second light guide (38) are covered by an extension (41*d*, 41*e*) of the cover member (41), and the cover member (41) is provided with the developing bias contact (50) and openings (41*a*, 41*b*) for exposing end surfaces of the first light guide (37) and second light guide (38).

According to this embodiment, the toner stirring member 42 disposed in the toner accommodating container 33 is assembled simultaneously with the integral molding of the toner accommodating container 33, so that the man-hours required for toner stirring-member 42 assembling can be reduced, and therefore, the operation efficiency in the assembling can be improved. As shown in FIG. 4, to the opening provided in the toner frame 45, a gear (unshown), for transmitting the driving force for rotating the toner stirring member 42, is engaged.

Referring to FIG. 7, designated by 70 is a cartridge positioning pin for positioning the cartridge by engagement with the main assembly when the developing cartridge is mounted to the main assembly 1.

According to this embodiment, the toner seal pulling direction is made different from the direction of the surface on which the seal is welded to the cap member, and the cap member is welded to the developing frame all around its circumference. Therefore, the proper strength balance in the structure is accomplished, and the warping of the toner frame and the developing frame can be avoided with high durability against vibration, falling or the like.

The toner frame is molded by an integral molding method, and the light transmission ports for toner remaining amount detection are formed in the toner container by insertion molding, so that larger amounts of toner can be accommodated by the same space as conventional toner containers. If the capacities are the same, the space occupied by the toner container can be reduced. By this, the main assembly of the image forming apparatus can be downsized.

With the foregoing structure, the positioning between the light transmission member and the light transmission port can be assured, so that light for the toner remaining amount detection can be assuredly passed with high accuracy. By the provision of the light guide on the developing frame side, the light guide can be exchanged together with the developing cartridge even if the light guide is contaminated. Therefore, the light guide always becomes fresh by the exchange of the developing cartridge. Thus, it is not necessary to assure the function of the light guide up to the end of the lifetime of the main assembly of the image forming apparatus, and therefore, cost reduction is possible by omitting the cleaning means or the like from the light guide.

When the light guide is covered by the cover member, the light guide is protected from contamination with the deposition of the scattered toner, so that a decrease in the light transmission factor can be avoided, and therefore, erroneous detection of the remaining amount of the toner can be prevented.

As described in the foregoing, according to the present invention, the detection accuracy of the remaining amount of the toner can be improved.

When a part of the light guide is supported by the cover member, the positional deviation due to vibration or falling can be prevented.

While the invention has been described with reference to the structures disclosed herein, it is not confined to the details set forth and this application is intended to cover such modifications or changes as may come within the purposes of the improvements or the scope of the following claims.

What is claimed is:

1. A developing cartridge for developing a latent image formed on an electrophotographic photosensitive member, wherein the developing cartridge is detachably mountable to a main assembly of an electrophotographic image forming apparatus, the developing cartridge comprising:

a developing member for developing a latent image formed on the electrophotographic photosensitive member with toner;

a toner accommodating portion for accommodating toner to be used by said developing member;

first and second light transmitting portions provided in said toner accommodating portion;

a first light guide for directing, to said first light transmitting portion, light emitted by a light emission member provided in the main assembly; and a second light guide for directing the light having passed through said second light transmitting portion to a light receiving element provided in the main assembly, wherein said first light transmitting portion and said second light transmitting portion are disposed at positions closer to a longitudinal end where a developing bias contact is provided than the opposite longitudinal end, wherein the developing bias contact receives a developing bias to be supplied to said developing member from the main assembly when said developing cartridge is mounted to the main assembly, and wherein said developing bias contact is exposed at a longitudinal end of said developing cartridge.

2. A developing cartridge according to claim 1, wherein an end of said first light guide is opposed to said first light transmitting portion, and the other end thereof is exposed at the end of the developing cartridge where said developing bias contact is provided.

3. A developing cartridge according to claim 1, wherein an end of said second light guide is opposed to said second light transmitting portion, and the other end thereof is exposed at the end of the developing cartridge where said developing bias contact is provided.

4. A developing cartridge according to claim 1 or 2, wherein said first light guide is positioned below said second light guide when said developing cartridge is mounted to the main assembly.

5. A developing cartridge according to claim 1, further comprising a filling opening for filling the toner into said toner accommodating portion provided at an end opposite from an end where said developing bias contact is provided, in the longitudinal direction of said toner accommodating portion.

6. A developing cartridge according to claim 1, 2, or 3, further comprising a cover which is detachably mounted to an end of said developing cartridge, wherein said first light guide and said second light guide are covered by an extension of said cover, and said cover is provided with said developing bias contact and openings for exposing end surfaces of said first light guide and said second light guide.

7. A developing cartridge according to claim 1, wherein materials of said first light guide and said second light guide are poly-methyl meta-acrylic resin.

8. A developing cartridge for developing a latent image formed on an electrophotographic photosensitive member, wherein said developing cartridge is detachably mountable to a main assembly of an electrophotographic image forming apparatus, said developing cartridge comprising:

a developing roller for developing a latent image formed on the electrophotographic photosensitive member with toner;

a developing bias contact for receiving a developing bias to be supplied to said developing roller from the main assembly when said developing cartridge is mounted to the main assembly, said developing bias contact being exposed at one longitudinal end of said developing cartridge;

a toner accommodating portion for accommodating the toner to be used by said developing roller;

first and second light transmitting portions provided in said toner accommodating portion, wherein said first light transmitting portion and said second light transmitting portion are disposed at positions closer to the longitudinal end where said developing bias contact is provided than the opposite longitudinal end;

a first light guide for directing, to said first light transmitting portion, light emitted by a light emission member provided in the main assembly, wherein one end of said light guide is opposed to said first light transmitting portion, and the other end thereof is exposed at the end where said developing bias contact is provided; and a second light guide for directing the light having passed through said second light transmitting portion to a light receiving element provided in the main assembly, wherein one end of said second light guide is opposed to said second light transmitting portion, and the other end thereof is exposed at the end of said developing cartridge where said developing bias contact is provided, and wherein when said developing cartridge is mounted to the main assembly, said second light guide is positioned above said first light guide.

9. A developing cartridge according to claim 8, further comprising a filling opening for filling the toner into the toner accommodating portion provided at an end opposite from an end where the developing bias contact is provided, in the longitudinal direction of said toner accommodating portion.

10. A developing cartridge according to claim 8 or 9, further comprising a cover which is detachably mounted to an end of said developing cartridge, wherein said first light guide and said second light guide are covered by an extension of said cover, and said cover is provided with said developing bias contact and openings for exposing end surfaces of said first light guide and said second light guide.

11. A developing cartridge according to claim 8, wherein materials of said first light guide and said second light guide are poly-methyl meta-acrylic resin.

12. An electrophotographic image forming apparatus for forming an image on a recording material, to which a developing cartridge is detachably mountable, comprising:

(a) a light emission member;

(b) a light receiving member;

(c) a main assembly developing bias contact;

(d) a mounting member for mounting a developing cartridge, which includes:

a developing roller for developing a latent image formed on an electrophotographic photosensitive drum with toner;

a developing bias contact for receiving a developing bias to be supplied to said developing roller from a main assembly of said electrophotographic image forming apparatus when the developing cartridge is mounted to the main assembly, said developing bias contact being exposed at one longitudinal end of the developing cartridge;

a toner accommodating portion for accommodating the toner to be used by said developing roller;

first and second light transmitting portions provided in said toner accommodating portion, wherein said first light transmitting portion and said second light transmitting portion are disposed at positions closer to a longitudinal end where said developing bias contact is provided than the opposite longitudinal end;

a first light guide for directing, to said first light transmitting portion, light emitted by said light emission member, said light emission member being provided in the main assembly, wherein one end of the first light guide is opposed to the first light transmitting portion, and the other end thereof is exposed at the end where said developing bias contact is provided; and a second light guide for directing the light having passed through said second light transmitting portion to said light receiving elements said light receiving element being provided in the main assembly, wherein one end of said second light guide is opposed to said second light transmitting portion and the other end thereof is exposed at an end of said developing cartridge where said developing bias contact is provided, and wherein when said developing cartridge is mounted to the main assembly, said second light guide is positioned above said first light guide;

said apparatus further comprising:

(e) a feeding member for feeding the recording material.

* * * * *

UNITED STATES PATENT AND TRADEMARK OFFICE

CERTIFICATE OF CORRECTION

PATENT NO. : 6,016,408
DATED : January 18, 2000
INVENTOR(S) : Kouji Hashimoto, et al.

It is certified that error appears in the above-identified patent and that said Letters Patent is hereby corrected as shown below:

Column 3:
Line 18, "A charging" should read --¶A charging-- and "A" (second occurrence) should read --An--.
Line 19, "n" should be deleted.

Column 4:
Line 9, "parts" should read --parts,--.

Column 5:
Line 6, "accumulation" should read --accumulated--.

Column 7
Line 18, "leaked" should read --leak--.
Line 45, "a" should read --is a--.
Column 8:
Line 16, "said" should be deleted.

Column 9:
Line 8, "said" should read --the--.
Line 11, "mounded" should read --mounted--.
Line 40, "members," should read --members--.

Column 10,
Line 26, "portion 33a" should read --portion 33a,--.

UNITED STATES PATENT AND TRADEMARK OFFICE

CERTIFICATE OF CORRECTION

PATENT NO. : 6,016,408
DATED : January 18, 2000
INVENTOR(S) : Kouji Hashimoto, et al.

It is certified that error appears in the above-identified patent and that said Letters Patent is hereby corrected as shown below:

Column 11:
Line 56, "said" should read --the--.

Column 13:
Line 4, "the" should read --said--.
Line 6, "the" should read --said--.

Column 14:
Line 32,"the" (second occurrence) should read --said--.
Line 34,"the" should read --said--.
Line 51, "member" should read --element--.

Column 15:
Line 10, "the" (second occurrence) should read --said--.
Line 11, "the" should read --said--.

Column 16:
Line 1, "elements" should read --element,--.
Line 7, "said" should read --the--.

Signed and Sealed this

Third Day of July, 2001

Nicholas P. Godici

*Attest:*

*Attesting Officer*

NICHOLAS P. GODICI
*Acting Director of the United States Patent and Trademark Office*